US007151233B2

(12) United States Patent
Puri et al.

(10) Patent No.: US 7,151,233 B2
(45) Date of Patent: Dec. 19, 2006

(54) CONTACT SYSTEM

(75) Inventors: Werner Puri, Nuremberg (DE); Joachim Seidl, Sulzbach-Rosenberg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/136,459

(22) Filed: May 25, 2005

(65) Prior Publication Data

US 2006/0131142 A1 Jun. 22, 2006

(30) Foreign Application Priority Data

May 26, 2004 (EP) ..... 04012444

(51) Int. Cl.
*H01H 15/00* (2006.01)

(52) U.S. Cl. ..... 200/16 C; 200/245

(58) Field of Classification Search ..... 200/290, 200/243, 245, 246, 250
See application file for complete search history.

(56) References Cited

U.S. PATENT DOCUMENTS 3,229,062 A 1/1966 Sharples et al.
3,762,684 A * 10/1973 Stein ..... 251/148
4,405,848 A 9/1983 Jaegle
4,437,611 A * 3/1984 Gilroy ..... 239/453
5,628,356 A * 5/1997 Marocco ..... 160/170
5,766,353 A * 6/1998 Madrzak et al. ..... 118/126
6,862,999 B1 * 3/2005 O'Donnell et al. ..... 105/199.3
6,957,611 B1 * 10/2005 O'Donnell et al. ..... 105/199.3
6,985,119 B1 * 1/2006 Forster et al. ..... 343/767
2001/0041079 A1 * 11/2001 Michlin et al. ..... 399/90
2002/0119364 A1 * 8/2002 Bushong et al. ..... 429/61
2004/0089193 A1 * 5/2004 O'Donnell et al. ..... 105/392.5
2004/0108190 A1 * 6/2004 Wong ..... 200/16 C
2004/0246710 A1 * 12/2004 Halasz et al. ..... 362/157
2006/0055686 A1 * 3/2006 Lee ..... 345/179

FOREIGN PATENT DOCUMENTS

DE 1 276 163 8/1968

* cited by examiner

*Primary Examiner*—Elvin Enad
*Assistant Examiner*—Lisa Klaus
(74) *Attorney, Agent, or Firm*—Harness, Dickey & Pierce, P.L.C.

(57) ABSTRACT

A contact system needs comparatively little overall space. that the contact system includes a spring element acting on the contact holder, fabricated from an electrically nonconducting material.

10 Claims, 3 Drawing Sheets

CONTACT SYSTEM

The present application hereby claims priority under 35 U.S.C. §119 on European patent application number EP 04012444.8 filed May 26, 2004, the entire contents of which is hereby incorporated herein by reference.

FIELD

The invention generally relates to a contact system, for example for electromechanical switchgear such as, for example, a contactor, position switch, command and feedback device or contactor combination.

BACKGROUND

A contact system has both a fixed contact and a moving contact. The fixed contact in this case serves to make contact with a connecting line or the like. The moving contact serves to open and close the contact system. For this purpose, the moving contact must be mounted in such a way that the switch pieces of the moving and of the fixed contact meet one another in a defined manner.

In order to make a secure contact, in addition the application of a defined contact-making force is necessary. In addition, the moving contact is to be largely decoupled from its drive or actuating element, for example a magnetic drive, slide, switch piece carrier, snap-action system or the like, in order to avoid negative kinetic influences.

For this purpose, it is known from the art to mount the moving contact by use of a metal spring which acts on the moving contact, directly or indirectly, for example via a movable contact holder or a snap-action system. This metal spring leads not only to a shortening of the air gaps and creep distances, but also, as an additional component, causes higher material and mounting costs and increases the risk of failure of the entire subassembly.

SUMMARY

It is an object of an embodiment of the invention to provide a contact system which needs comparatively little overall space.

According to an embodiment, the contact system has a fixed contact, in particular for making contact with a connecting line, and a moving contact which can be actuated by a drive or actuating element in order to open and close the electrical connection to the fixed contact. Furthermore, a contact holder is provided to hold the moving contact. Connected to the contact holder is a spring element made of an electrically nonconducting material. This spring element is used to spring the moving contact.

An aspect of an embodiment of the invention is to substitute the spring material used hitherto for the spring element. Instead of a metallic spring, an electrically nonconducting spring element is now used. Air gaps and creep distances are not shortened, which means that a considerable reduction in the necessary overall space is possible.

If the contact holder likewise includes an electrically nonconducting material, negative influences on the bearing point of the spring element and contact holder or the position of the moving contact in the event of heating or cooling can in this case be reduced further on the basis of temperature expansion coefficients which are identical to the greatest possible extent.

The material from the spring element, according to a further advantageous embodiment of the invention, is a thermoplastic (such as PES, PESU, PEI, PPS, POM, PA) or an elastomer. The unfavorable post-oscillation of the moving contact is reduced as compared with the use of a metal spring, since materials of this type have a greater damping constant than metal.

The use of plastics such as thermoplastics or elastomers at the same time permits integration of functional areas on the contact holder. In this way, the subassembly can be configured so as to be improve or even optimized in terms of mounting, for example having guide and bearing surfaces. This reduces development, material and mounting costs. The functional areas are in one example case, formed in order to produce a snap-action, latching or press connection.

A mounting element is expediently provided, which permits automated handling of the spring element. This can be, for example, a mounting hole, which can have an internal contour. For the purpose of better handling by a gripper, the spring element in a further embodiment of the invention has a profile which can be gripped easily, for example is angular.

BRIEF DESCRIPTION OF THE DRAWINGS

The present invention will be described in more detail in the following text by using example embodiments, which will be explained with the aid of the drawings, in which.

DETAILED DESCRIPTION OF THE EXAMPLE EMBODIMENTS

Figure 1:
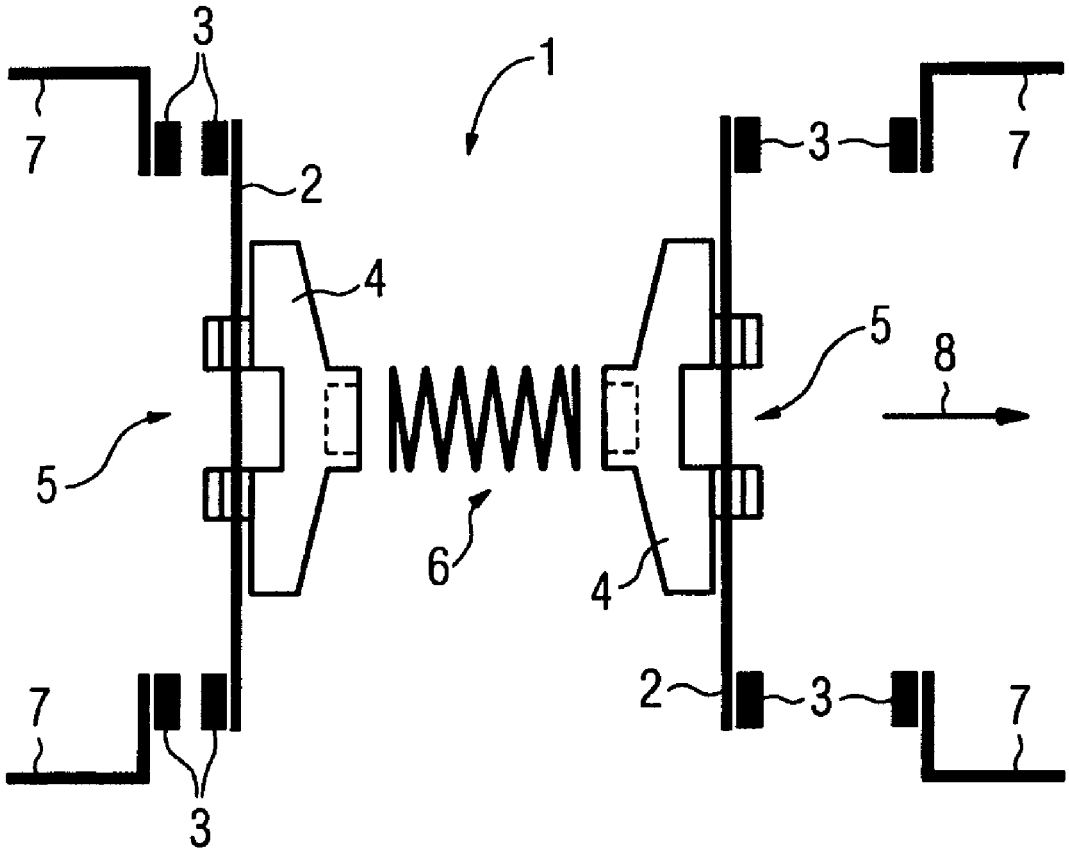
FIG 1 PRIOR ART
FIG. 1 shows a schematic illustration of a contact system according to the prior art.

A known contact system 1 according to the prior art is shown by FIG. 1. The moving contact 2 with its two switch pieces 3 fitted at the ends is in this case fitted to a contact holder 4. This contact holder has a holding region 5 for the moving contact 2. The contact holder 4 is mounted by way of a metal spring 6 which, as a bridge spring, at the same time produces the connection to the opposite contact system 2, of identical construction. If the contact is actuated by a drive or actuating element (not illustrated), the moving contact 2 is moved in the contact-making direction 8 onto a fixed contact 7, the switch pieces 3 of the moving contact 2 and the fixed contact 7 meeting one another in a defined manner.

FIGS. 2 to 6 show contact holders 10 having spring elements 11 made of electrically nonconducting material. In order to illustrate better the contact ends 12 of the spring elements 11, FIGS. 2 to 6 show exploded illustrations.

Figure 2:
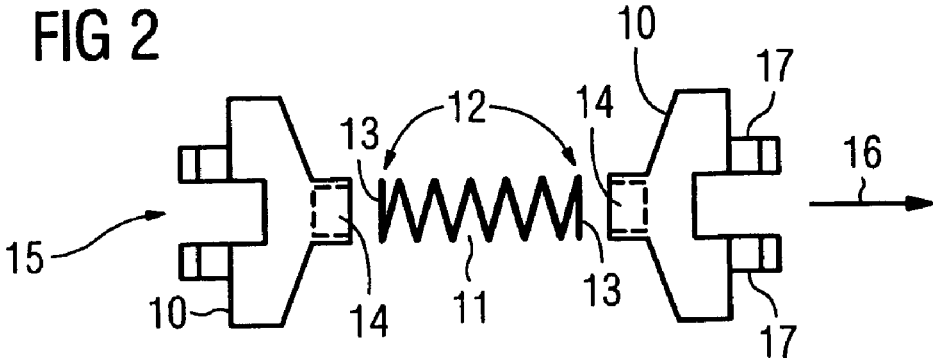
FIG. 2 shows an embodiment of a contact holder having a spring element like a helical spring.

The two contact holders 10 depicted in FIG. 2 for moving contacts are connected to each other by an electrically nonconducting spring element 11 like a helical spring. The spring element 11 can, however, also have other shapes, as illustrated in the following figures. The spring action is in this case primarily predefined by the contour shape of the spring element 11 and, moreover, by the suitable selection of an elastic or elastoplastic material for the spring element 11.

The spring element 11 depicted in FIG. 2 has flat end faces 13 on its contact ends 12. For the purpose of mounting, the spring element 11 is inserted with its end faces 13 in holding openings 14 provided for this purpose on the contact holders 10 or pushed onto corresponding contact projections.

Each contact holder 10 has a holding region 15 to hold a movable contact (not depicted). Each holding region 15 in this case comprises two pairs of holding elements. Each pair of holding elements has two holding elements 17 which are spaced apart from each other and extend in the connecting direction 16. In order to produce a mechanical connection between moving contact and contact holder 10, a snap-action or latching hook 18 is provided on each holding element 17. During the mounting of the moving contact on the contact holder 10, the moving contact is pushed with its appropriately provided snap-action recesses onto the two snap-action hooks 18 of the respective pair of holding elements.

Figure 3:
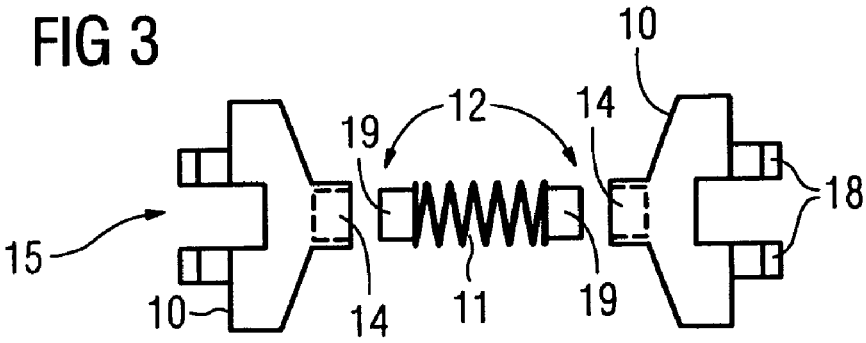
FIG. 3 shows an embodiment of a contact holder having a spring element like a helical spring with integrated functional areas.

FIG. 3 shows a further embodiment of a spring element 11 of the type of a helical spring. This spring element 11 has functional areas 19 at the ends. These functional areas 19 are used to mount or fix the spring element 11 on the contact holders 10. They may be designed, for example, to form a snap-action or latching connection between spring element 11 and contact holder 10. If the spring element 11 is made of a plastic material, the functional areas 19 can expediently be integrated or injection-molded on.

Figure 4:
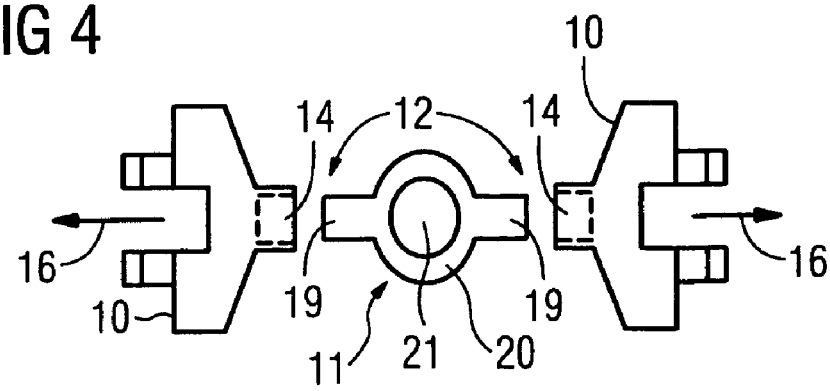
FIG. 4 shows an embodiment of a contact holder having a spring element like a sprung ring with a mounting hole.

The embodiment depicted in FIG. 4 has a spring element 11 like an annular disk with a compressed oval cross-section, the functional areas 19 being integrally molded on both sides of the spring ring 20. The annular opening 21 is used at the same time as a mounting hole for mounting the spring element 11. For example, defined automatic picking up and handling of the spring element 11 can be carried out, by a mounting pin being inserted into the mounting hole of the spring element 11 and the spring element 11 being picked up and moved. Manual mounting or complicated handling via compressed air is no longer necessary.

Figure 5:
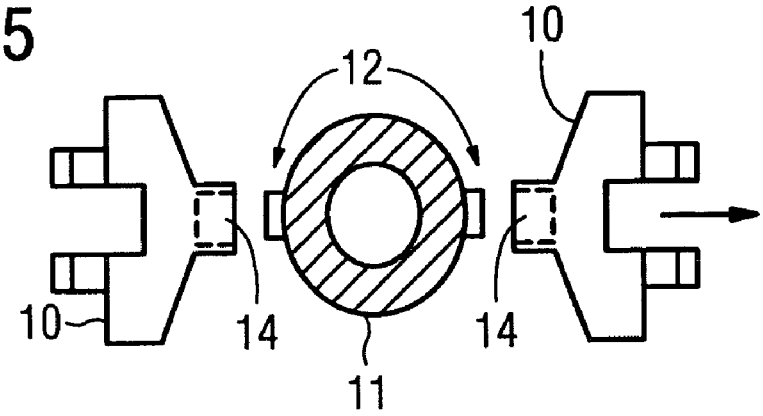
FIGS. 5 to 6 show an embodiment of a contact holder having a spring element like a sphere.
Figure 6:
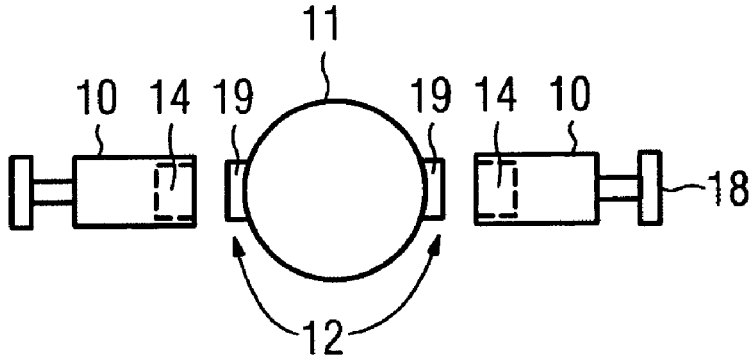
Figure 7:
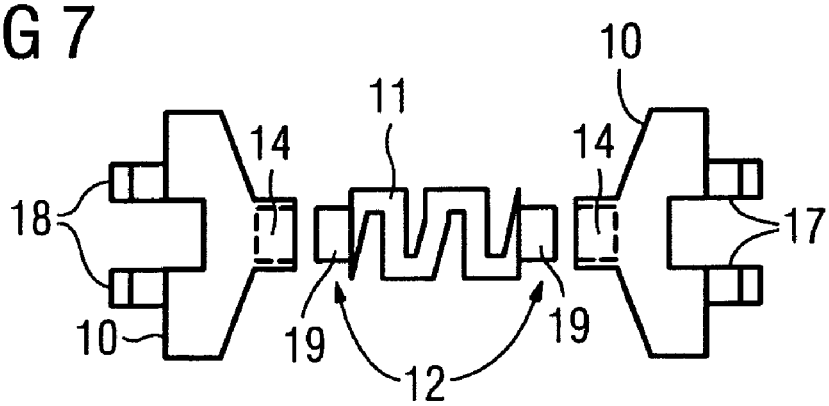
FIG. 7 shows an embodiment of a contact holder with a serpentine spring element.

FIGS. 5 and 6 show a further embodiment of a contact holder 10, in which the spring element 11 is designed as a hollow sphere. In this case, FIG. 5 illustrates a view with a spring element 11 partly cut open, while FIG. 6 depicts a plan view. Instead of a hollow sphere, a solid sphere can also be used. A contact holder 10 having a serpentine spring element 11 is depicted in FIG. 7.

Embodiments of the present invention can be used for any desired types of contact systems, in particular for contact systems having a bridge spring or the like for the defined application of a contact force. This relates both to contact systems with a snap-action or a slow make and break system, in particular position switches, and also magnet actuated contact systems, in particular contactors.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A contact system, comprising:

a fixed contact;

a moving contact, to produce an electrical connection to the fixed contact;

a contact holder to hold the moving contact; and a spring element, of an electrically nonconducting material, connected to the contact holder;

wherein the spring element has at least one functional element on the connecting side.

2. The contact system as claimed in claim 1, wherein the spring element includes at least one of a thermoplastic and an elastomer material.

3. The contact system as claimed in claim 2, wherein the spring element has at least one functional element on the connecting side, for at least one of mounting and fixing to the contact holder.

4. The contact system as claimed in claim 2, wherein the spring element has a mounting element.

5. The contact system as claimed in claim 2, wherein the spring element has a mounting hole to accommodate a mounting pin.

6. The contact system as claimed in claim 1, wherein the spring element has a mounting element.

7. The contact system as claimed in claim 1, wherein the spring element has a mounting hole to accommodate a mounting pin.

8. A contact system, comprising:

a fixed contact;

a moving contact, to produce an electrical connection to the fixed contact;

a contact holder to hold the moving contact; and a spring element, of an electrically nonconducting material, connected to the contact holder;

wherein the spring element has at least one functional element on the connecting side, for at least one of mounting and fixing to the contract holder.

9. The contact system as claimed in claim 8, wherein the spring element has a mounting element.

10. A contact system, comprising;

a fixed contact;

a moving contact, to produce an electrical connection to the fixed contact;

a contact holder to hold the moving contact; and a spring element, of an electrically nonconducting material, connected to the contact holder;

-wherein the spring element has a mounting hole to accommodate a mounting pin.

* * * * *